US006122385A

United States Patent [19]

Konno et al.

[11] Patent Number: 6,122,385

[45] Date of Patent: Sep. 19, 2000

[54] SOUND REPRODUCTION APPARATUS WITH STABLE FEEDBACK

[75] Inventors: Fumiyasu Konno, Hirakata; Sumio Ishihara, Takatsuki; Akinori Hasegawa, Takasago, all of Japan

[73] Assignee: Matsushita Electric Industrial Co., Ltd., Osaka, Japan

[21] Appl. No.: 08/892,893

[22] Filed: Jul. 15, 1997

[30] Foreign Application Priority Data

Jul. 16, 1996 [JP] Japan ..... 8-185768

[51] Int. Cl.[7] ..... H04R 3/00

[52] U.S. Cl. ..... 381/96; 381/59; 381/56

[58] Field of Search ..... 381/96, 59, 98, 381/111, 113, 120, 56, 57

[56] References Cited

U.S. PATENT DOCUMENTS

| | | | |
|---|---|---|---|
| 4,180,706 | 12/1979 | Bakgaard | 381/96 |
| 4,395,588 | 7/1983 | Franssen et al. | 381/96 |
| 5,559,891 | 9/1996 | Kuusama et al. | 381/96 |

FOREIGN PATENT DOCUMENTS

| | | | |
|---|---|---|---|
| 62-76393 | 4/1987 | Japan | 381/96 |
| 5-183978 | 7/1993 | Japan | 381/96 |

*Primary Examiner*—Ping Lee
*Attorney, Agent, or Firm*—McDermott, Will & Emery

[57] ABSTRACT

The object of the present invention is to offer an sound reproduction apparatus equipped with a speaker having a drastically improved acoustic characteristics securing a stable and high S/N ratio over a wide frequency range. In order to accomplish these objects, the inputted audio signal is amplified by a power amplifier and is reproduced in an acoustic output by driving a speaker, and the reproduced acoustic output is detected by a microphone disposed in a closed cabinet together with said speaker and the detected signal is amplified by a microphone amplifier and is processed by a filter. Then, the output signal from said filter and the input signal to said power amplifier are added and processed, and the difference signal between the added signal and said inputted audio signal is used as an input signal to said power amplifier constituting a negative feedback circuit accomplishing the objects of this invention.

15 Claims, 19 Drawing Sheets

SOUND REPRODUCTION APPARATUS WITH STABLE FEEDBACK

BACKGROUND OF THE INVENTION

This invention relates to a sound reproduction apparatus used in various audio sound systems. Conventionally, a negative feedback circuit has been incorporated in the sound reproduction apparatus in order to secure a stable and high S/N ratio over a wide frequency range improving the acoustic characteristics of speaker.

The sound reproduction apparatus with a conventional negative feedback circuit has been constructed as shown in FIG. 19 where the signal is inputted into input terminal 1 through the positive input terminal of subtracter 2, the output signal of this is amplified by power amplifier 3, and is supplied to speaker 5 disposed in closed cabinet 4. Then, a negative feedback loop is constructed by detecting the acoustic signal radiated from speaker 5 by microphone 6, by amplifying the detected signal by microphone amplifier 7, and by connecting this output signal to the negative input terminal of subtracter 2 through filter 8.

However, with the negative feedback circuit of conventional construction, a phase difference between the electrical signal inputted in speaker 5 and the acoustic signal radiated from speaker 5 is changed as shown in FIG. 20 producing a negative feedback near the phase difference of 0 degree while producing a positive feedback near the phase difference of +180 or −180 degrees producing a problem of unstable and inadequate feedback.

Furthermore, when the bandwidth is limited by filter 8 to obtain a suitable margin for oscillation, the improvement of acoustic characteristics by the application of negative feedback can be obtained only in a limited frequency band so that the improvements of acoustic characteristics can not be obtained well.

Furthermore, since the phase angle at the lowest resonant frequency of speaker 5 is +90° which is in a boundary between the positive and the negative feedback, no improvement of the acoustic output signal in the lowest resonant frequency range could be obtained. Moreover, when microphone 6 detecting the acoustic signal radiated from speaker 5 is disposed in front of speaker 5 as shown in FIG. 19, a problem of detecting not only the acoustic signal radiated from speaker 5 but the external acoustic signals is produced, resulting an inadequate S/N ratio.

SUMMARY OF THE INVENTION

The objects of the present invention are to solve the above-mentioned conventional technical problems, and to apply a stable feedback and to obtain a sound reproduction apparatus able to realize excellent sound reproduction characteristics. In order to accomplish these objectives, the invented sound reproduction apparatus is consisted of: a subtracter connected to an input terminal, a power amplifier amplifying the output signal of said subtracter, a speaker enclosed in a closed cabinet reproducing the output signal of said power amplifier, a microphone disposed in said closed cabinet detecting the acoustic signal radiated from said speaker, a microphone amplifier amplifying the acoustic signal detected by said microphone, a filter processing the output signal of said microphone amplifier, and an adder adding and processing the output signal of said filter to the input signal of said power amplifier, constructing a negative feedback circuit by connecting the output signal of said adder to said subtracter.

By constructing the above mentioned negative feedback circuit, a negative feedback circuit around the lowest resonant frequency having an enough S/N ratio can be obtained by processing the signal detected by the microphone. Moreover, the oscillation due to positive feedback can hardly be taken place by applying the feedback of only the in-phase signal components obtained by adding the signal inputted in the speaker to the acoustic signal radiated from the speaker. Thus, the negative feedback becomes applicable over a wide frequency range attaining a sound reproduction apparatus having better acoustic characteristics.

Moreover, since the speaker, the power amplifier, and its signal processing circuits are installed in a closed cabinet, and the microphone detecting the acoustic output is mounted on a common printed circuit board in the invented sound reproduction apparatus, the microphone and the microphone amplifier can be connected at a shortest distance at a lowest cost requiring no particular wiring of long distance between the microphone and the microphone amplifier so that a sound reproduction apparatus having excellent characteristics can be obtained.

DESCRIPTION OF THE PREFERRED EMBODIMENT

Figure 1:
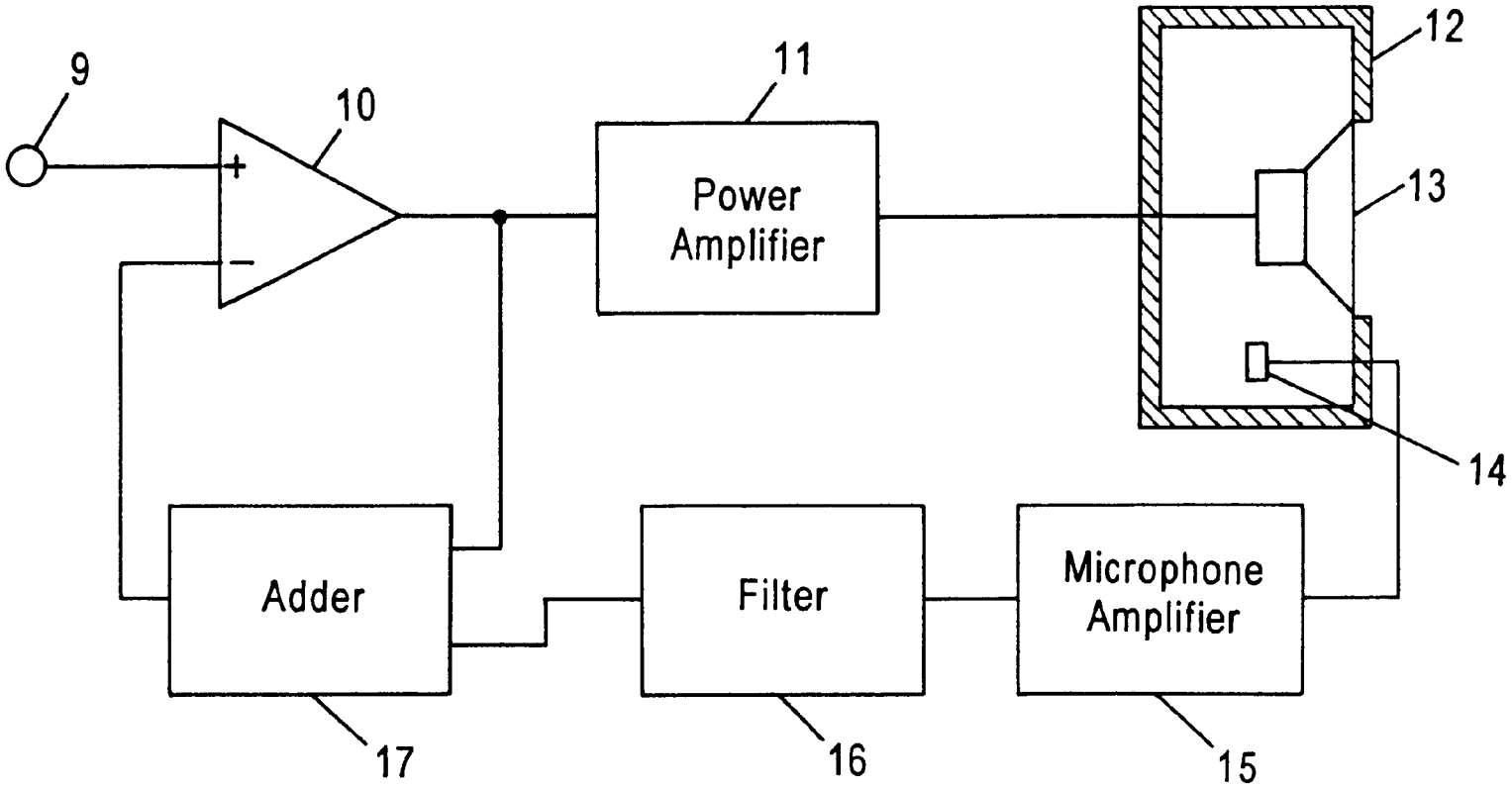
FIG. 1 shows a block diagram showing an embodiment of the invented sound reproduction apparatus.

A block diagram of preferred embodiment in Form-1 of the invented sound reproduction apparatus is shown in FIG. 1 wherein the signal inputted in terminal 9 is inputted in the positive input terminal of subtracter 10, and the output signal of subtracter 10 is inputted in power amplifier 11 and is amplified. As speaker 13 is connected to the output of power amplifier 11, its acoustic output signal is radiated from speaker 13. Speaker 13 is installed in a closed cabinet 12 together with microphone 14 by which the acoustic signal radiated from speaker 13 is detected.

That is, an acoustic signal radiated from speaker 13 in closed cabinet 12 is detected by microphone 14, and the acoustic signal detected by microphone 14 is amplified by microphone amplifier 15, and the amplified output signal is connected to filter 16 wherein the processing of the amplified signal is performed.

Then, the signal processed by filter 16 and the signal outputted from said subtracter 10 are added and processed by adder 17, and a negative feedback circuit is constructed by inputting the output signal of adder 17 into the negative input terminal of subtracter 10.

The transfer function of the circuit constructing the sound reproduction apparatus in Form-1 of an embodiment of the invention shown in FIG. 1 can be expressed by Equation (1) shown below specifying the transfer function (gain of amplifier) of power amplifier 11 by A, each of the amplification gains of adder 17 and subtracter 10 by 1, the transfer function of signal processing filter 16 by $T_{F(S)}$, the transfer function of the sound system including microphone 14, microphone amplifier 15 and speaker 13 installed in closed box 12 by $T_{(S)}$, the input voltage to input terminal 9 by $V_{in}$, and the output voltage of power amplifier 11 by $V_{out}$.

$$V_{out}/V_{out}=A/\{2+A\cdot T_{(S)}\cdot T_{F(S)}\} \quad (1)$$

Generally, if the absolute value of the denominator of Eq.(1) is larger than 1, the circuit shown in FIG. 1 is in a condition of negative feedback, but if smaller than 1, the circuit is in a condition of positive feedback, therefore an oscillation (howling) may occur depending on the condition.

Figure 19:
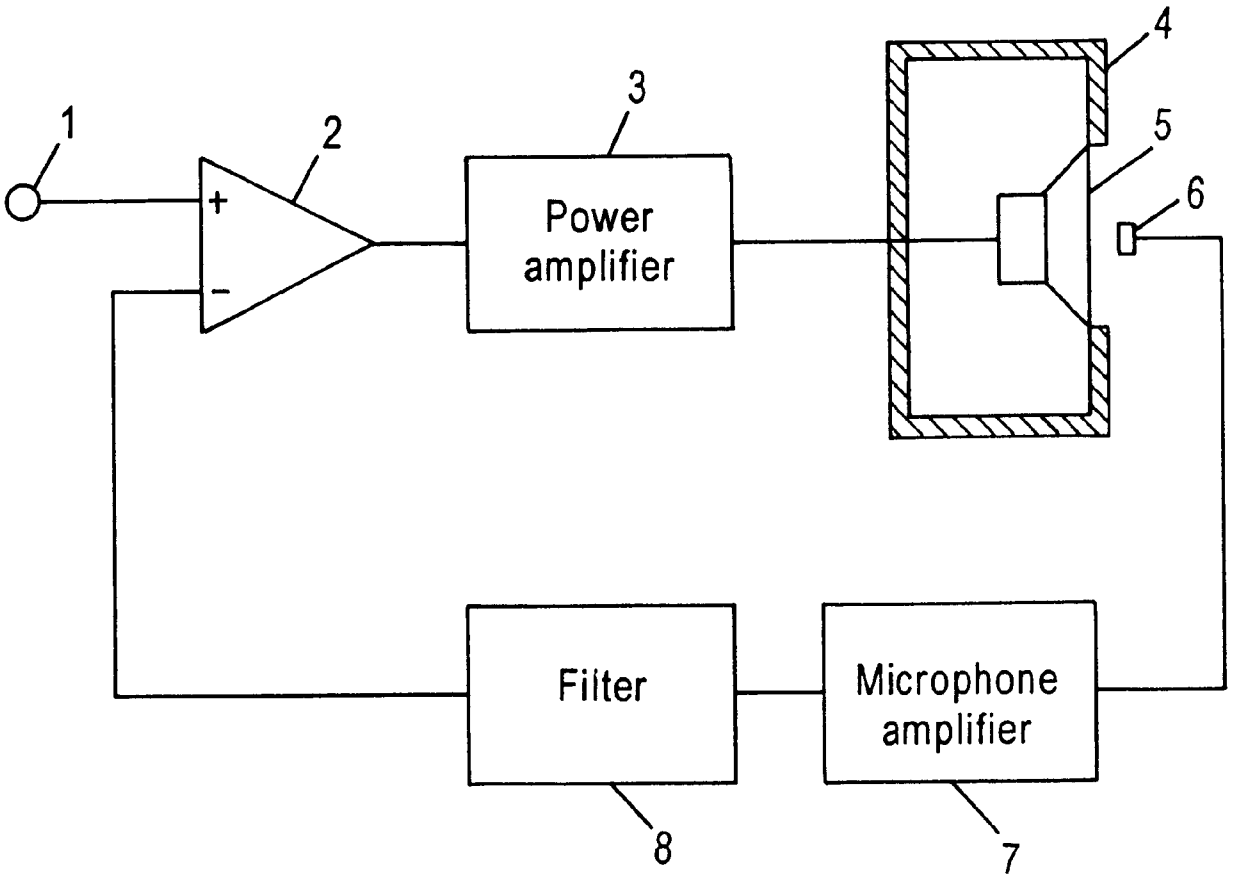
FIG. 19 (PRIOR ART)
FIG. 19 shows a block diagram of the sound reproduction apparatus employing the conventional negative feedback circuit.

In addition to this, the transfer function of a typical negative feedback circuit shown in FIG. 19 can be expressed by Equation (2).

$$V_{out}/V_{in}=A/\{1+A\cdot T_{(S)}\cdot T_{F(S)}\} \quad (2)$$

Comparing the transfer function of conventional circuit with the one of invented circuit, obviously, a negative feedback degree higher than the one of conventional circuit can be obtained.

Figure 2:
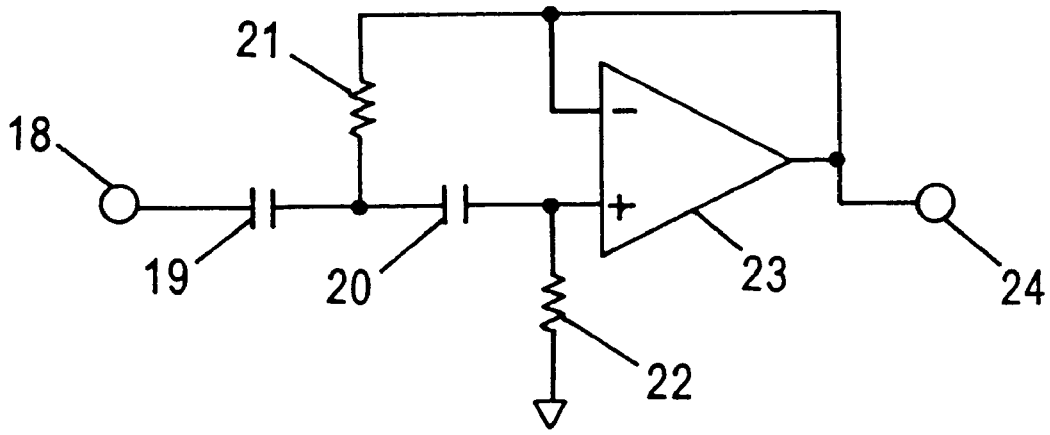
FIG. 2 shows a circuit diagram of the filter used in Form-1 which is an embodiment of the invented sound reproduction apparatus.
Figure 3:
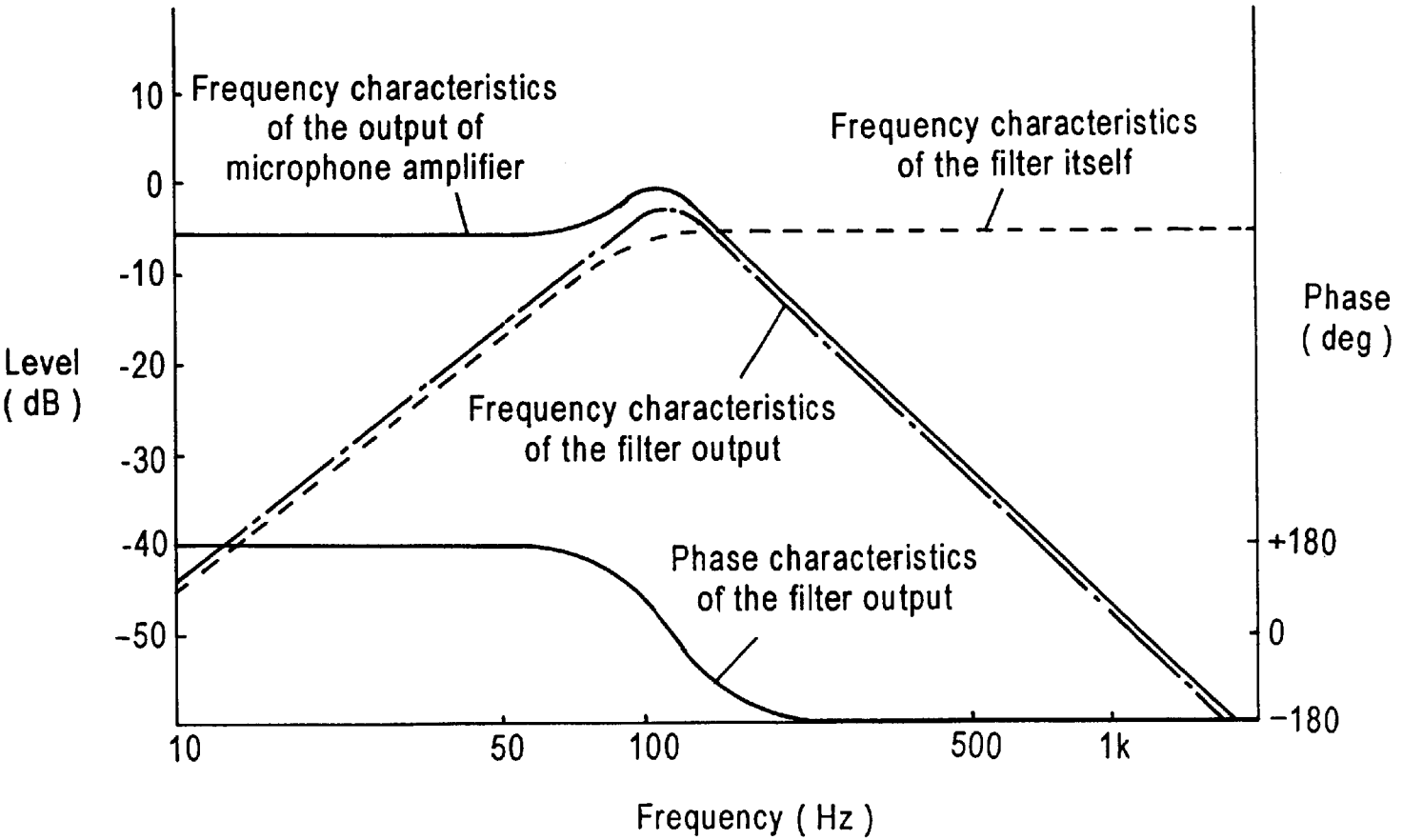
FIG. 3 shows frequency characteristics of the filter itself employed in a negative feedback circuit in Form-1 which is an embodiment of the invented sound reproduction apparatus, and shows also an output of the microphone amplifier and a frequency characteristic of the output of filter used in the feedback circuit.

Then, filter 16 for signal processing connected to the output of microphone amplifier 15 is now explained. FIG. 2 shows a structure of the filter in Form-1 of the embodiment of the invention, and this filter is called a second order high-pass filter of feedback type consisting of terminals 18 and 24, capacitors 19 and 20, resistors 21 and 22, and operational amplifier 23. As shown in FIG. 3, this filter has characteristics attenuating at a rate of 12 dB/Oct below the cutoff frequency (about 120 Hz).

As shown in FIG. 3, the frequency characteristics of the signal detected by microphone 14 is flat beyond the lowest resonant frequency (about 120 Hz) and FIG. 3 shows a attenuating level also at a rate of 12 dB/Oct above the lowest resonant frequency (about 120 Hz). Since these characteristics are same as the characteristics of a second order low-pass filter, a peak is produced at the lowest resonant frequency like the frequency characteristics shown in FIG. 3 where the Q of the speaker is high.

Figure 20:
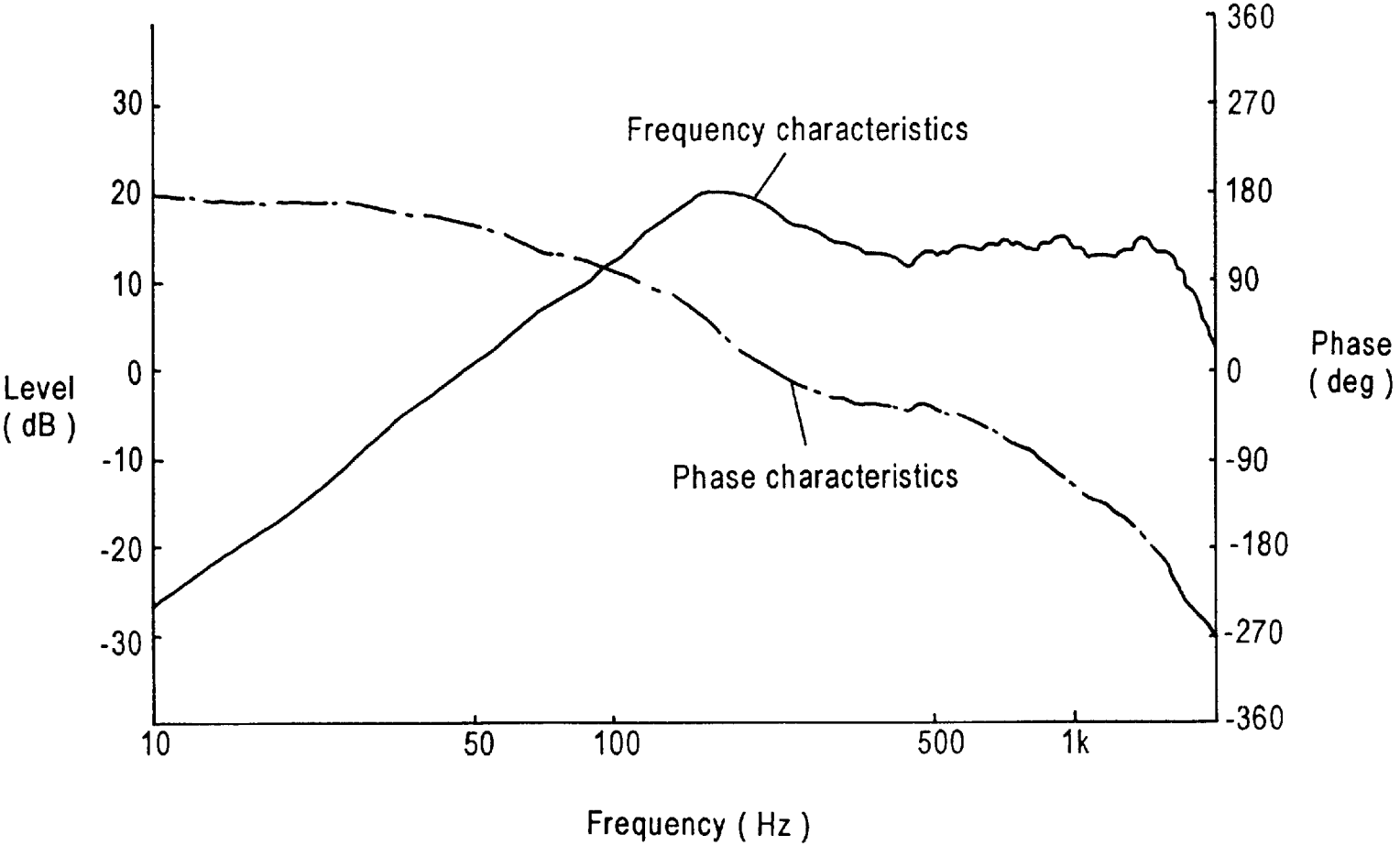
FIG. 20 (PRIOR ART)
FIG. 20 shows frequency characteristics of the sound pressure level and the phase of sound wave radiated from a speaker.

When the signal detected by microphone 14 is inputted in filter 16 through microphone amplifier 15, frequency characteristics attenuating its level at a rate of 12 dB/Oct in the frequency bands in before and behind the lowest resonant frequency bands are obtained as shown in the frequency characteristics of filter output signal in FIG. 3. At this time, the cut-off frequency of filter 16 is coincided with the lowest resonant frequency of speaker 13 where the Q of the speaker is set at 0.7. Considering the frequency and the phase characteristics of the output of this speaker, these are equivalent to the characteristics of the signals radiated from speaker 13 and detected by the microphone disposed in front of the speaker below the resonant frequency as shown in FIG. 20.

Moreover, since the frequency characteristics of filter 16 is flat above the lowest resonant frequency, the frequency characteristic of the output signal of microphone amplifier 15 is appeared as it is, and its level is attenuated at a rate of 12 dB/Oct. That is, an output signal of filter 16 same as the one obtained by detecting the frequency characteristics of speaker 13 by a microphone disposed in front of the speaker and by cutting off the high-frequency components of the signal at a cut-off frequency same as the lowest resonant frequency at a rate of 12 dB/Oct can be obtained.

In addition to this, since the phase of output signal of filter 16 is changed by 0° at the lowest resonant frequency, and is changed by +180°, or −180° at the neighborhood of it, it is possible to set the feedback degree at a maximum in the lowest resonant frequency of speaker 13.

Figure 4:
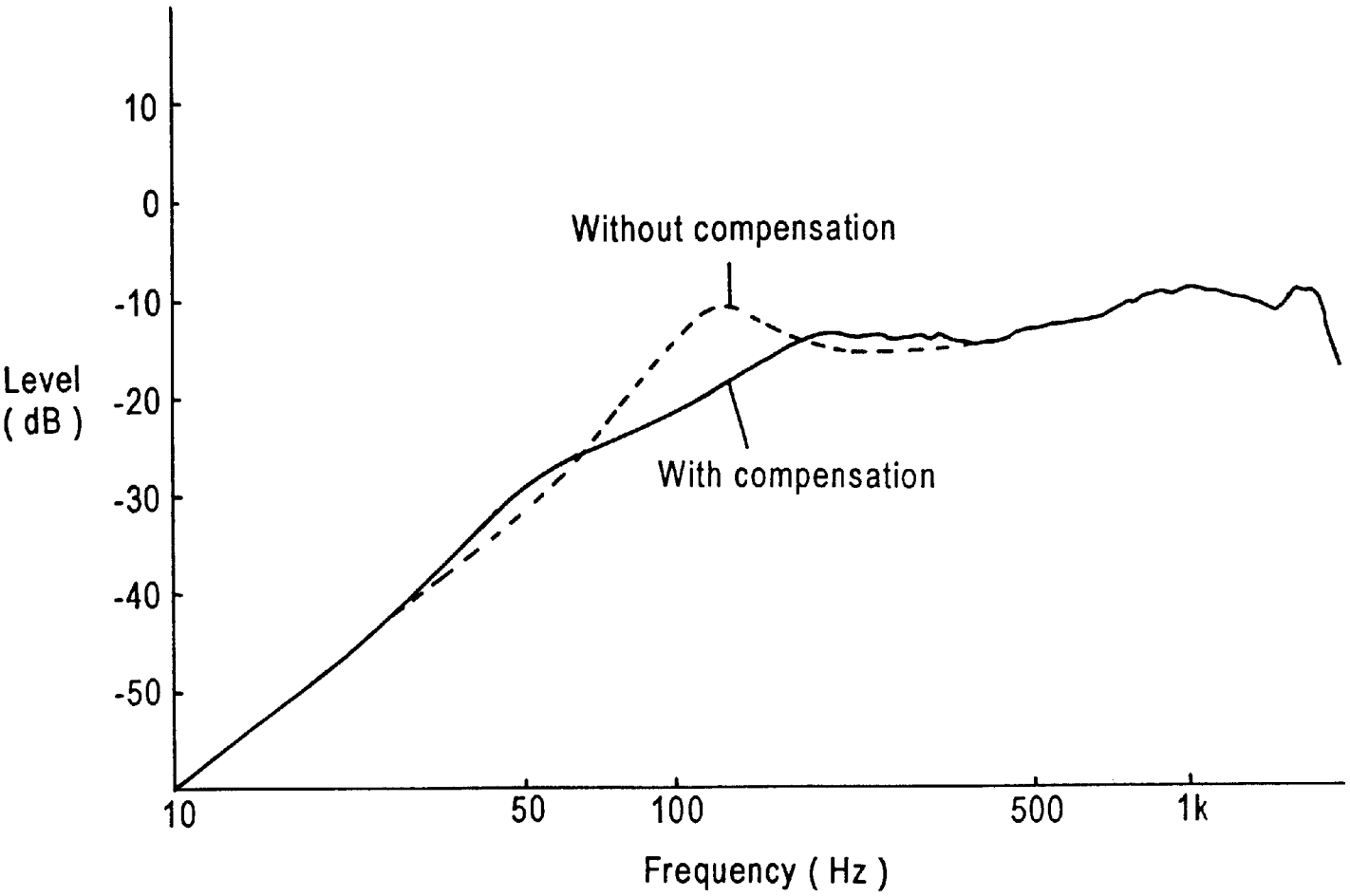
FIG. 4 shows frequency characteristics comparing an acoustic output signal of the speaker having a compensated frequency characteristics with the one of the speaker having an uncompensated frequency characteristics in Form-1 which is an embodiment of the invented sound reproduction apparatus.

FIG. 4 shows a frequency characteristic of speaker 13 obtained when its frequency characteristic is compensated according to the invention, compared with the one obtained by the one having an uncompensated characteristic.

Figure 5:
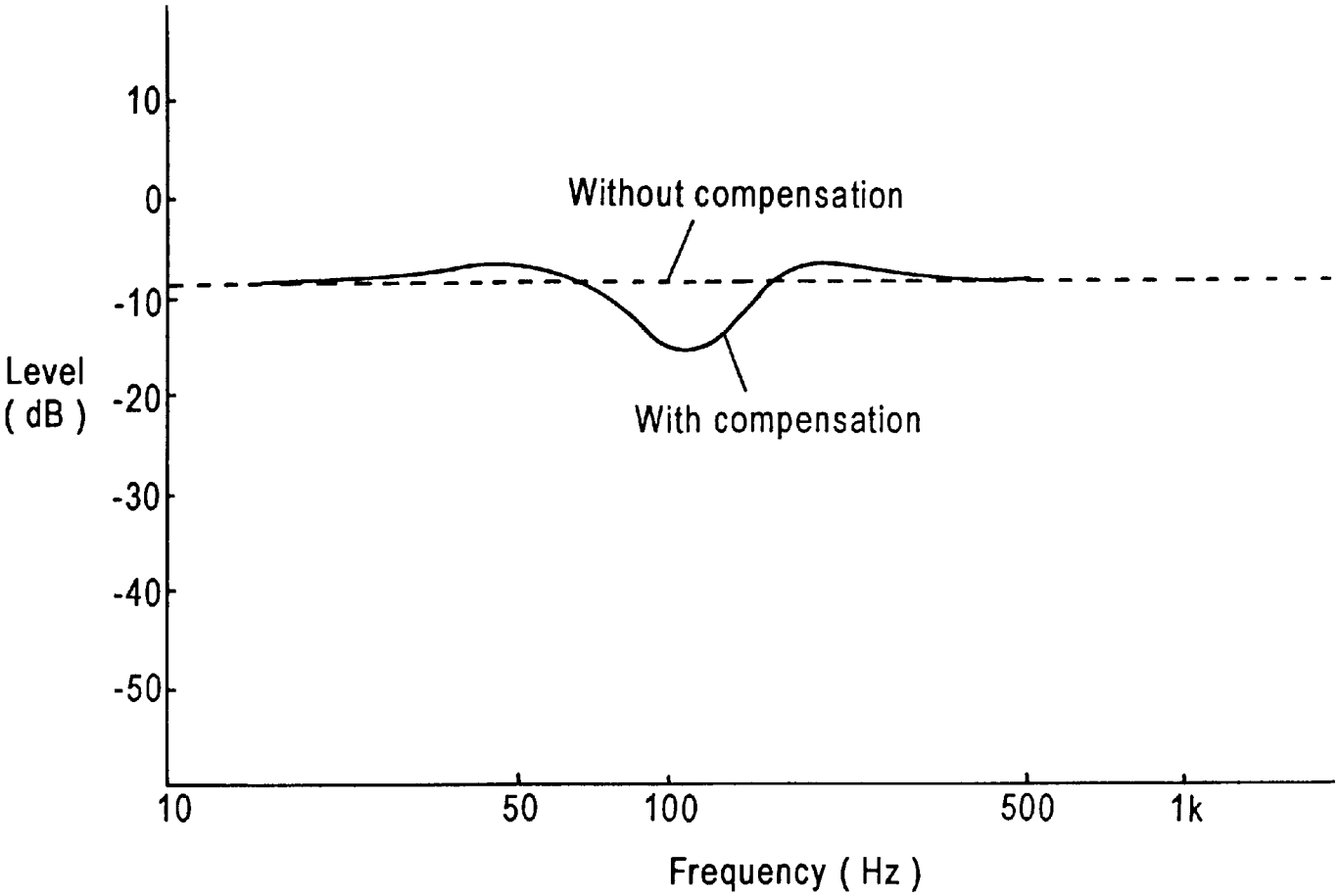
FIG. 5 shows frequency characteristics of the outputs of power amplifier obtained with a speaker having a compensated frequency characteristics compared with the one obtained with a speaker having an uncompensated frequency characteristics in Form-1 which is an embodiment of the invented sound reproduction apparatus.

FIG. 5 shows frequency characteristics of the output of power amplifier 11 obtained with speaker 13 of which frequency characteristics is compensated compared with the one obtained with an uncompensated speaker. A comparison of FIGS. 4 and 5 shows a considerable improvement of the peaks existing in near of the lowest resonant frequency of speaker 13.

Figure 6:
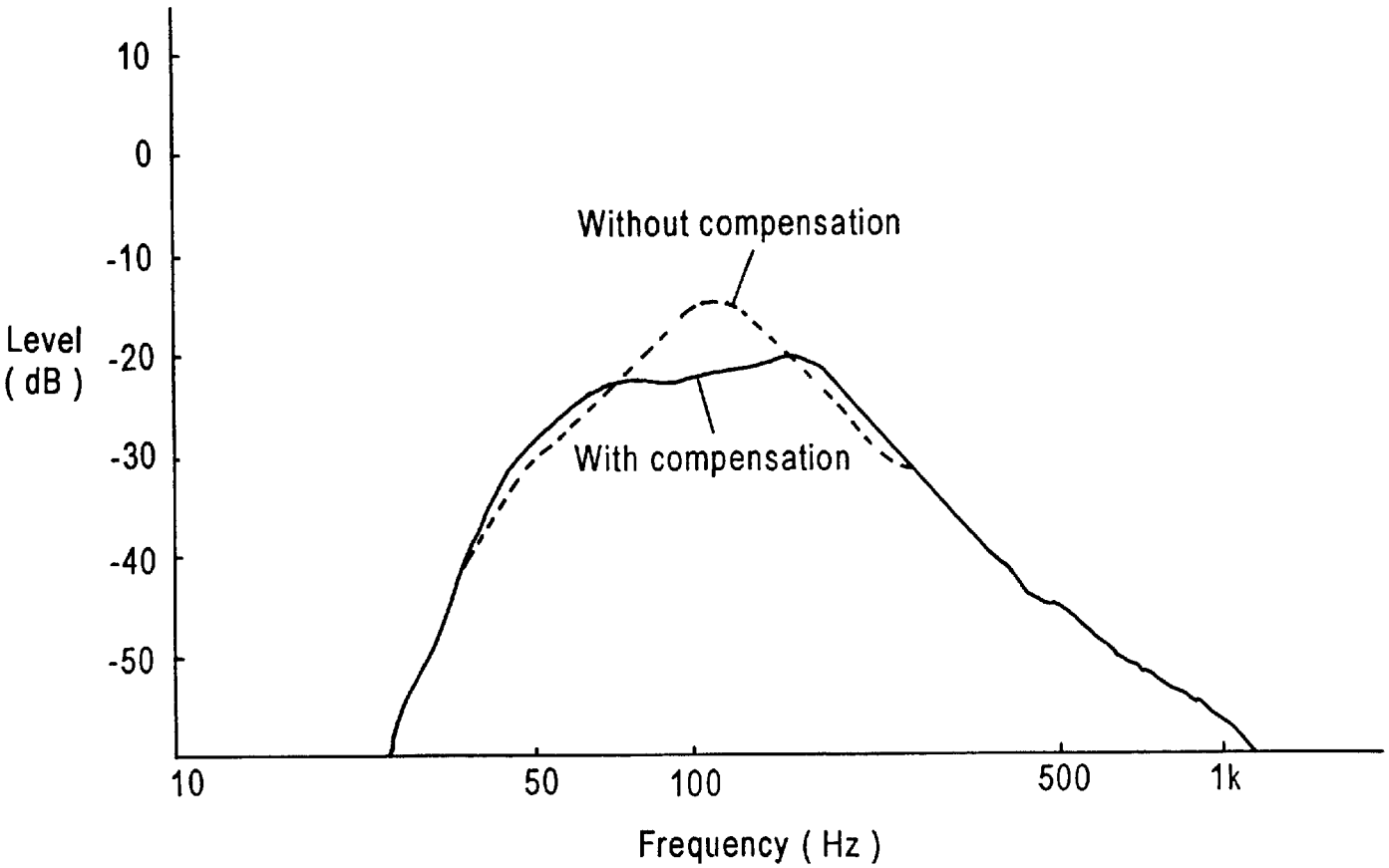
FIG. 6 shows frequency characteristics of the acoustic output of woofer having a compensated characteristic compared with the one obtained by a woofer having an uncompensated characteristic in Form-1 which is an embodiment of the invented sound reproduction apparatus.

In addition to these, FIG. 6 shows a comparison of the acoustic output signals of speaker 13 when its frequency characteristics is compensated and uncompensated using speaker 13 as a woofer. FIG. 6 shows a flatter frequency characteristics and a wider reproduction bandwidth of the compensated speaker.

Figure 7:
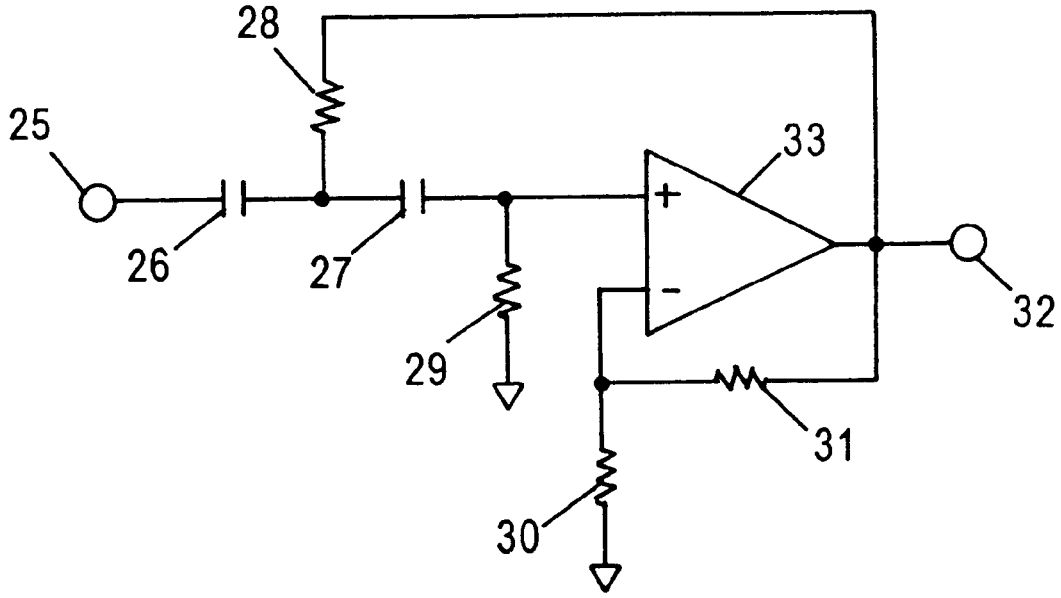
FIG. 7 shows a circuit diagram of the filter used in Form-2 which is an embodiment of the invented sound reproduction apparatus.

Then, a sound reproduction apparatus in Form-2 of the embodiment of the invention is now explained by referring the attached drawing. The fundamental structure of feedback circuit in Form-2 is same as the one shown in FIG. 1, and a circuit shown in FIG. 7 is used as filter 16 in this case. The circuit shown in FIG. 7 constitutes a second order high-pass filter which can have a gain of amplifier, and this consists of: terminals 25 and 32, capacitors 28, 29, 30 and 31, and operational amplifier 33.

Figure 8:
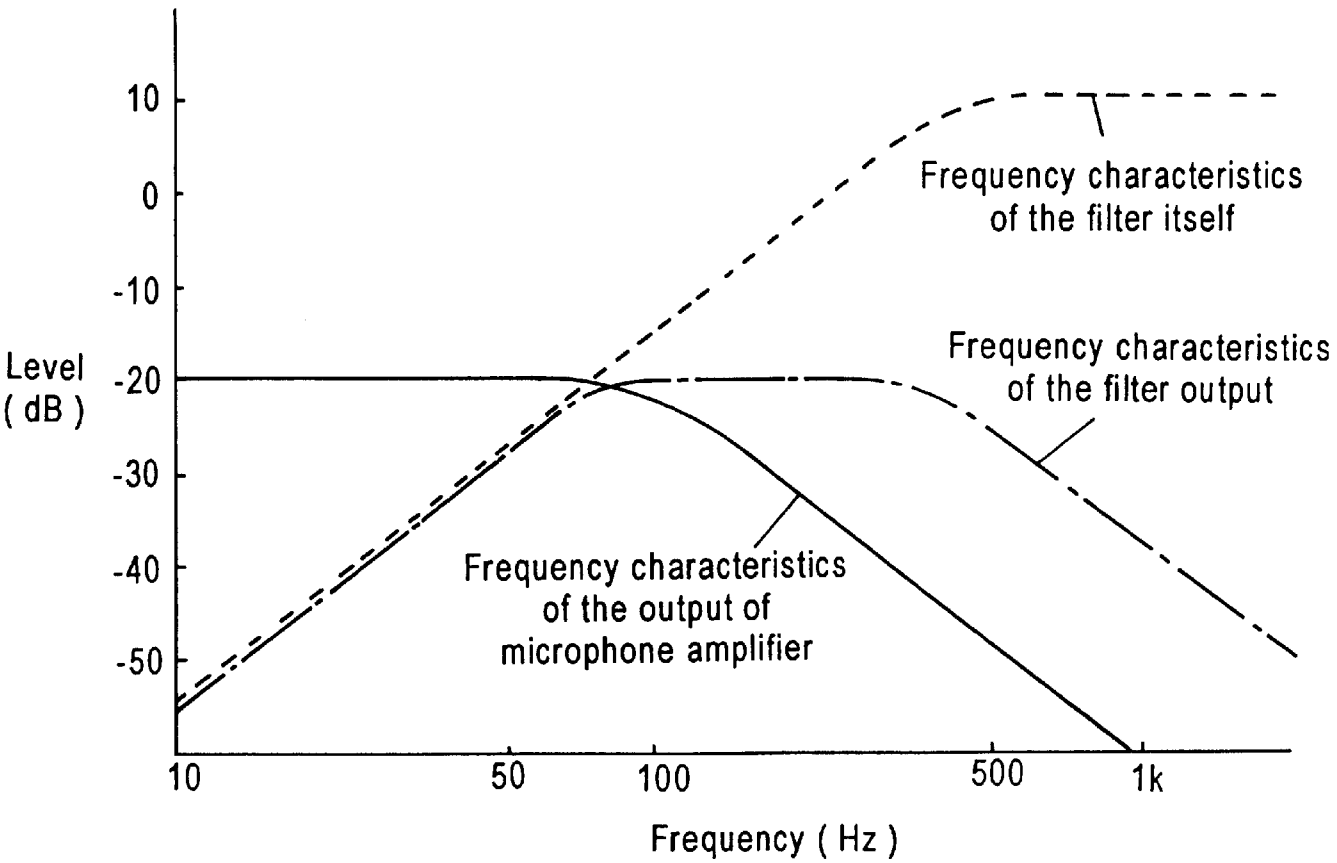
FIG. 8 shows frequency characteristics of the filter itself used in the negative feedback circuit in Form-2 which is an embodiment of the invented sound reproduction apparatus, and shows also frequency characteristics of the output of microphone amplifier and the one of the filter.

FIG. 8 shows frequency characteristics of this filter itself, frequency characteristics of the microphone amplifier, and frequency characteristics of the output signal of filter obtained when a signal is supplied to the filter through the microphone amplifier.

By setting the cutoff frequency of filter 16 at a frequency higher than the lowest resonant frequency of speaker 13, and by amplifying this by about 33 dB by using operational amplifier 33 shown in FIG. 7, frequency characteristics equivalent to the frequency characteristics attainable by disposing a microphone in front of speaker 13 and by attenuating the high-frequency components near 400 Hz at a rate of 12 dB/Oct can be obtained.

Figure 9:
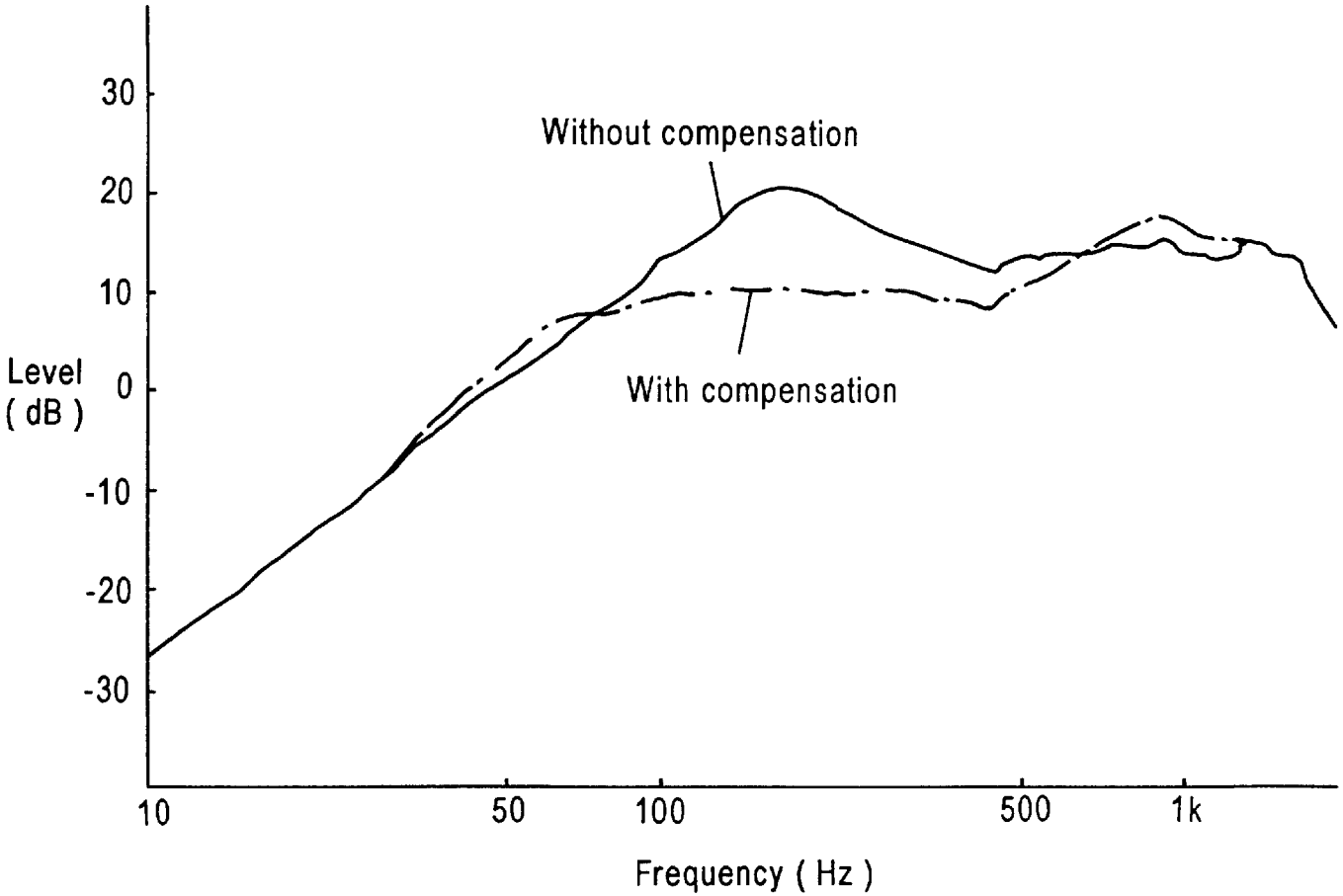
FIG. 9 show frequency characteristics of the acoustic output signal of a speaker having compensated characteristics compared with one of a speaker having uncompensated characteristics in Form-2 which is an embodiment of the invented sound reproduction apparatus.

FIG. 9 shows a case where the frequency characteristics of speaker is compensated by using the output signal of filter 16 compared with a case where the one is obtained by an uncompensated speaker. This shows a possible improvement of frequency characteristics above the lowest resonant frequency comparing to a previously shown case of Form-1 which is an embodiment of the invention.

Then, a sound reproduction apparatus in Form-3 of the embodiment is now explained by referring the attached drawing. Although the fundamental structure of feedback circuit used in this sound reproduction apparatus in Form-3 is same as the circuit shown in FIG. 1, the circuit shown in FIG. 10 is used to construct filter 16.

Figure 10:
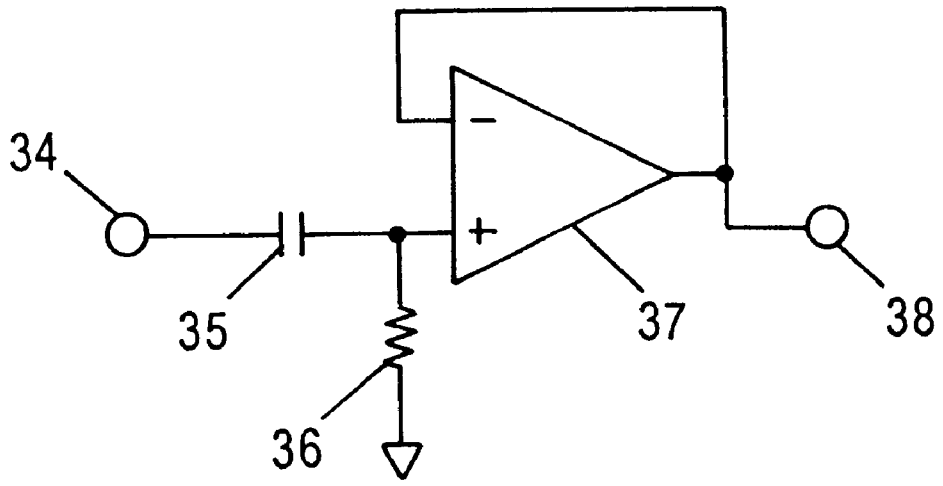
FIG. 10 shows a circuit diagram of the filter in Form-3 which is an embodiment of the invented sound reproduction apparatus.

The circuit shown in FIG. 10 consists of; capacitor 35 connected between terminals 34 and 38, resistor 36, and operational amplifier 37 constituting a first order high-pass filter. Operational amplifier 37 is an amplifier having a gain equal to 1 for obtaining a low output impedance.

Figure 11:
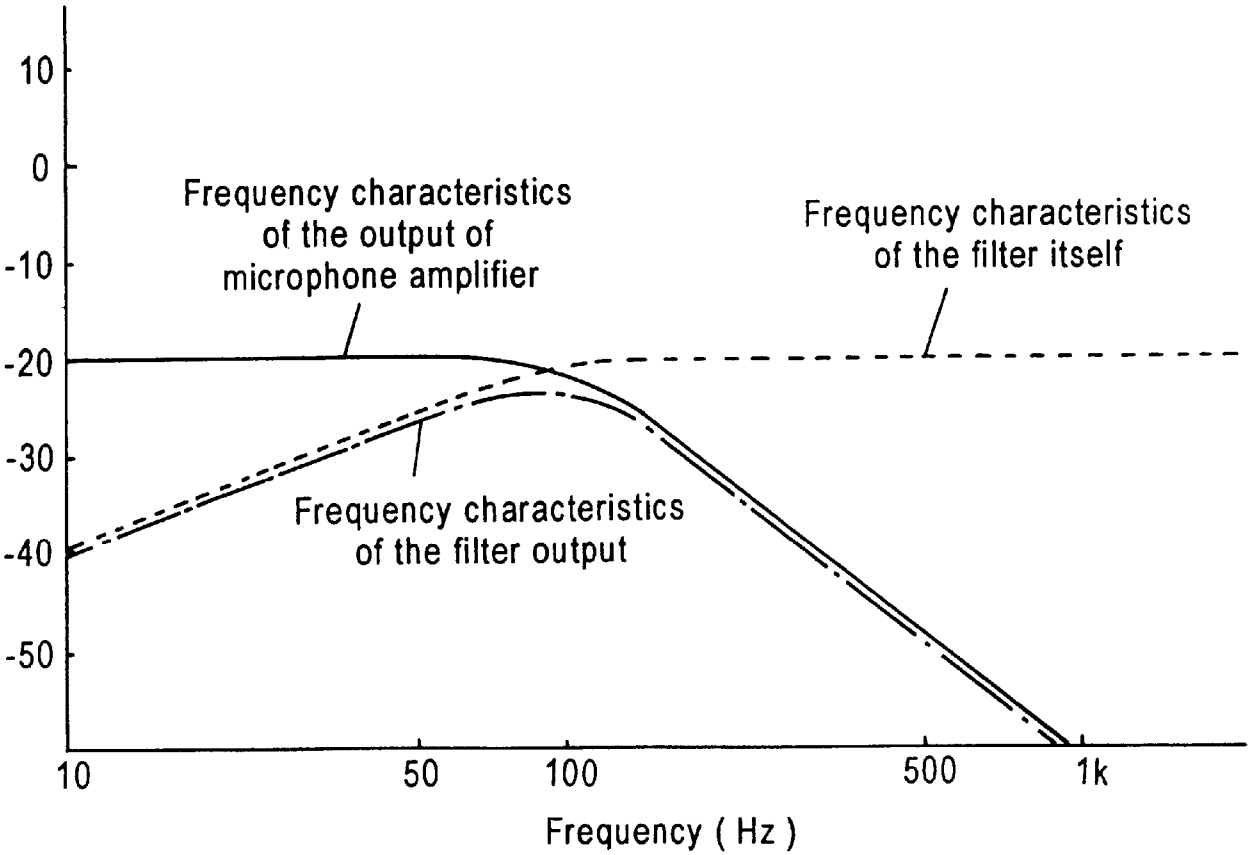
FIG. 11 show a frequency characteristic of the filter itself, and shows also frequency characteristics of the output signals of microphone amplifier and filter.

FIG. 11 shows frequency characteristics of filter 16, of microphone amplifier 15, and of the output signal of filter 16 obtained when a signal is fed to filter 16 through the microphone amplifier.

Comparing the frequency characteristics shown in FIG. 11 with the before-mentioned frequency characteristics obtained by Form-1 shown in FIG. 3, the frequency characteristics of the output signal of filter 16 shown in FIG. 11 is attenuated at a rate of 12 dB/Oct in a frequency region above the lowest resonant frequency of speaker 13 like the one obtained by Form-1 but is attenuated at a rate of 6 dB/Oct below the lowest resonant frequency signal.

Figure 12:
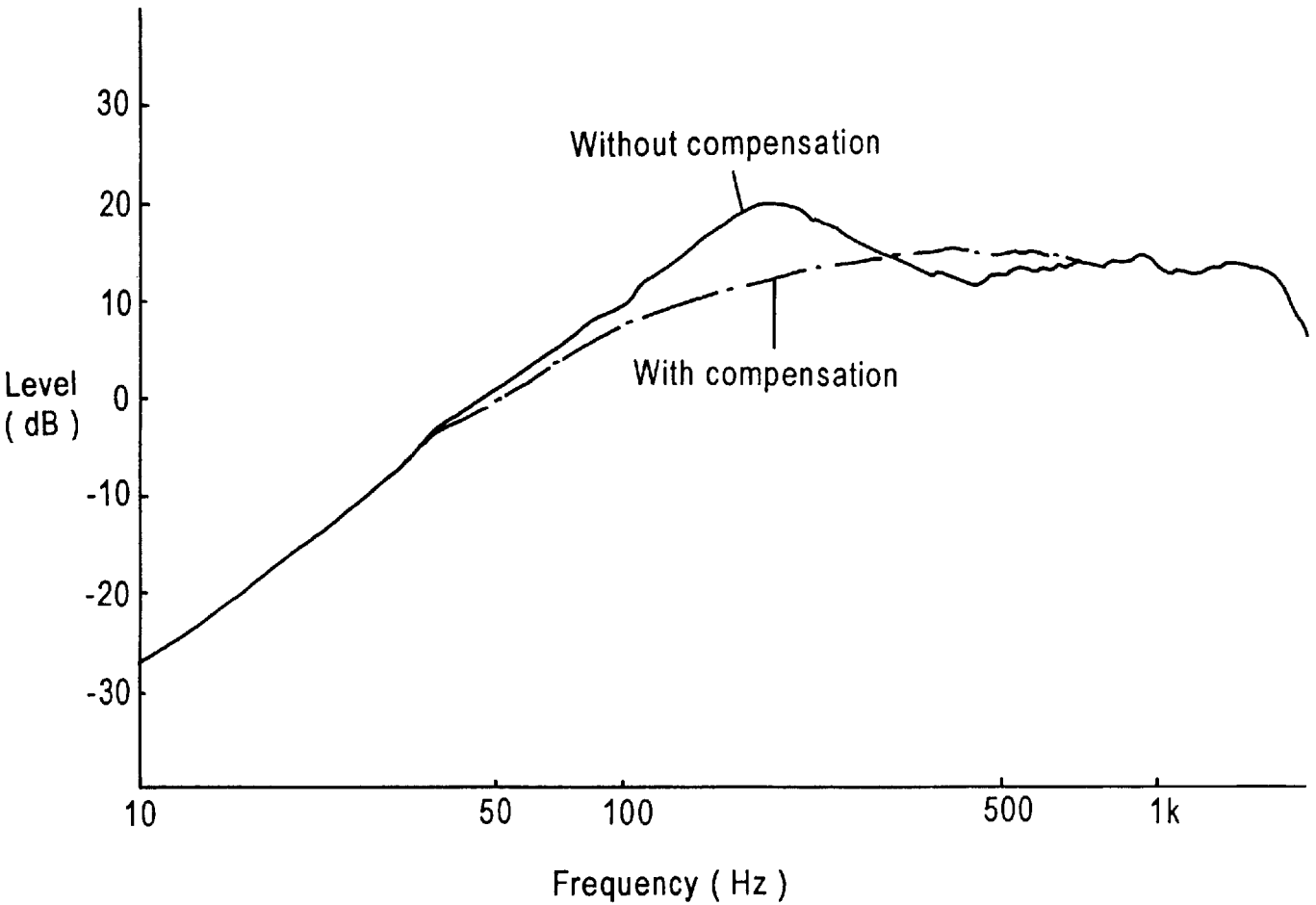
FIG. 12 shows frequency characteristics of the acoustic output signal obtained with a speaker having compensated characteristics compared when one obtained with a speaker having uncompensated characteristics in Form-3 of an embodiment of the invented sound reproduction apparatus.

As shown above, although the frequency characteristics of the output signal of filter 16 is different from that of acoustic signal detected at the front of speaker 13 especially in the low frequency range, a more stable feedback can be applied since the phase of signal passed through the first order high-pass filter is limited at a maximum degree of +90° below the cut-off frequency. FIG. 12 shows frequency response curves of the acoustic output signal of speaker 13 with compensation of its frequency characteristics and without compensation.

Figure 13:
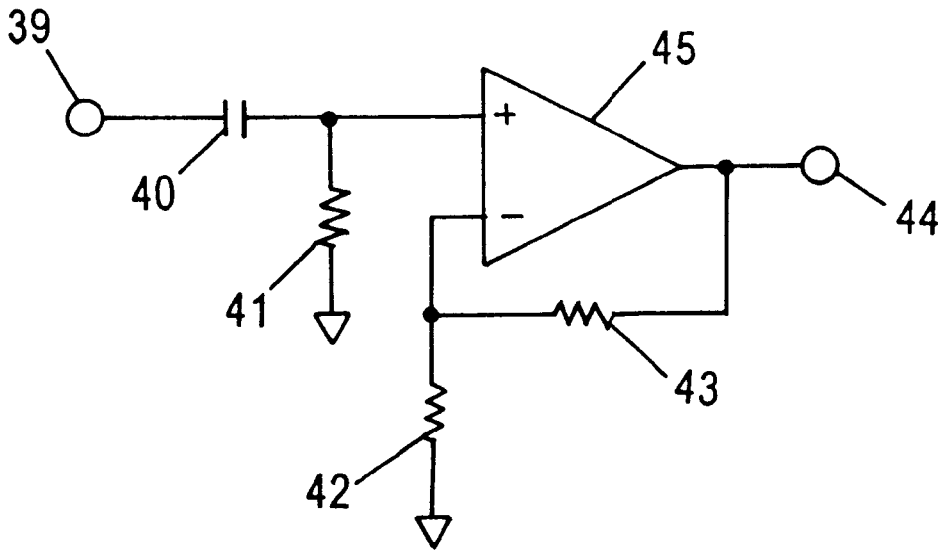
FIG. 13 shows a circuit diagram of the filter in Form-4 of the embodiment of the invented sound reproduction apparatus.

A sound reproduction apparatus in Form-4 is now explained next as an embodiment of the invention. Although the fundamental structure of this feedback circuit is nearly same as the one shown in FIG. 1, the circuit shown in FIG. 13 is employed in filter 16. The circuit shown in FIG. 13 is a first order high-pass filter having a gain of amplifier, and the filter is consisted of capacitor 40 and resistor 41, and the amplifier is consisted of resistors 42 and 43 and operational amplifier 45. Terminals 39 and 40 are the input and the output terminals respectively.

Figure 14:
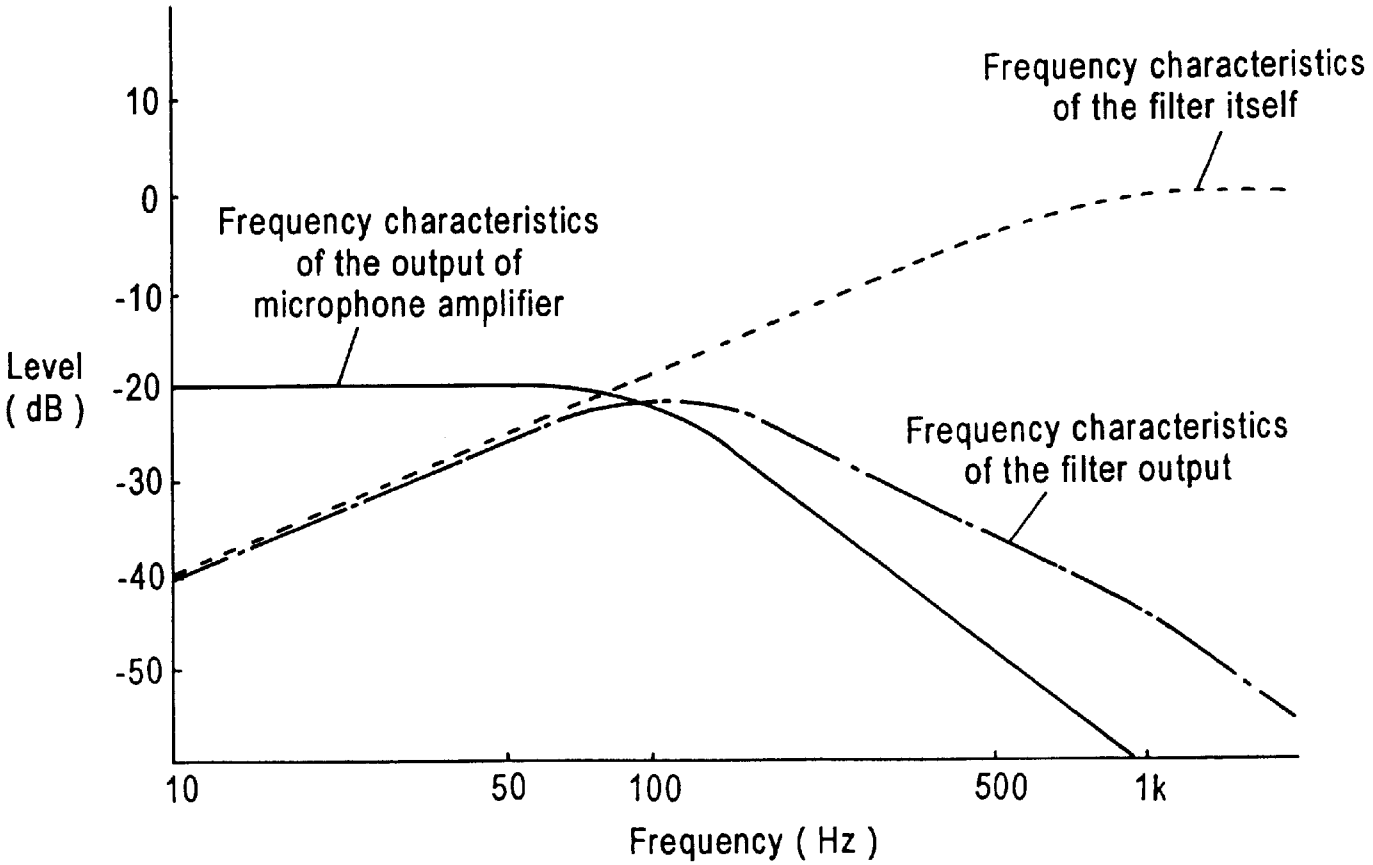
FIG. 14 shows frequency characteristics of the filter itself used in the negative feedback circuit in Form-4 of the embodiment of the invented sound reproduction apparatus, and shows also frequency characteristics of the output signals of microphone amplifier and filter incorporated in the circuit.
Figure 15:
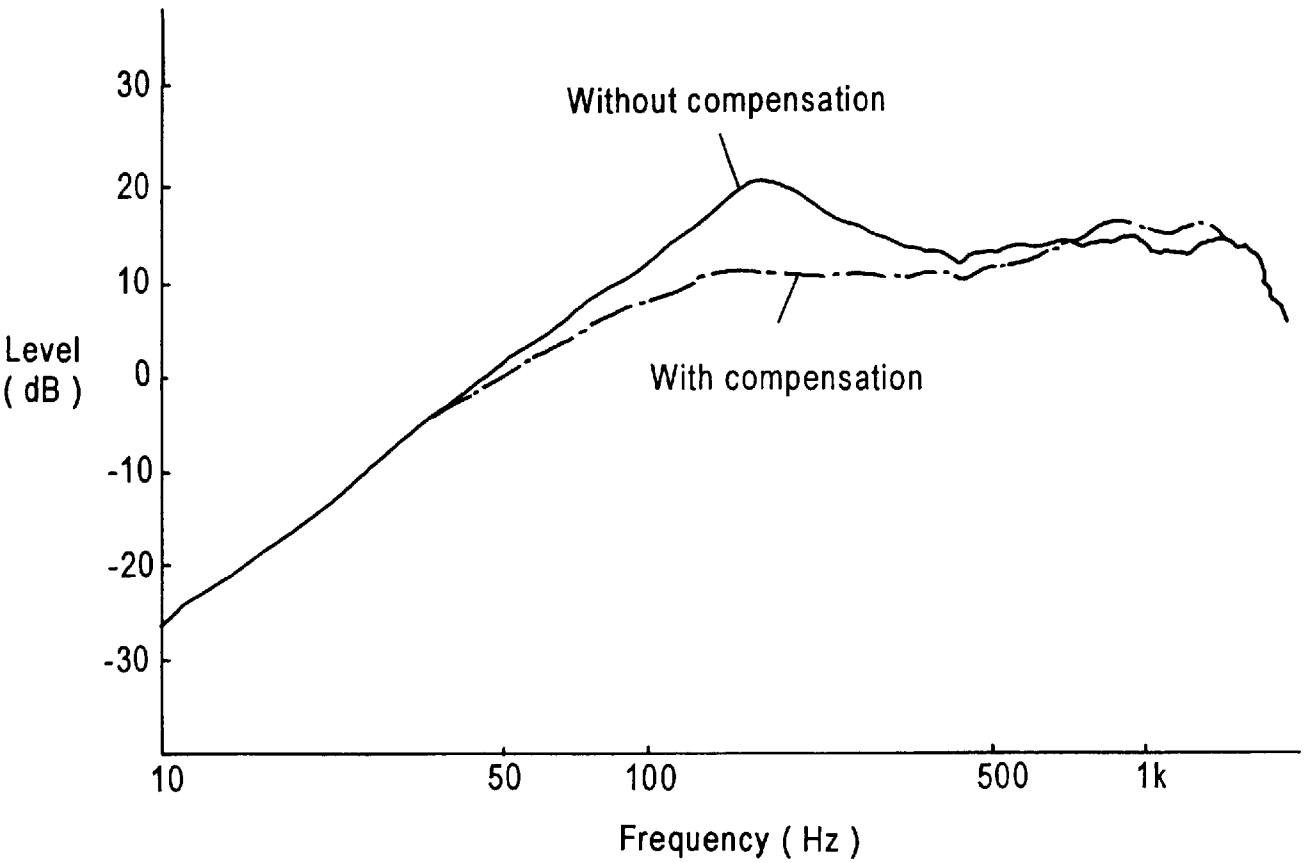
FIG. 15 shows frequency characteristics of the acoustic output of a speaker having compensated frequency characteristics compared with ones having uncompensated frequency characteristics in Form 4 of an embodiment of the invented sound reproduction apparatus.

The frequency characteristics of filter 16 itself, of microphone amplifier 15, and of the output signal of filter 16 obtained when the signal is fed to filter 16 through microphone amplifier are shown in FIG. 14 where the frequency characteristics of the output of filter 16 shows an attenuation at a rate of 6 dB/Oct starting from the lowest resonant frequency of speaker 13 toward the cut-off frequency of filter 16. This shows an attenuation further at a rate of 12 dB/Oct above the cut-off frequency of filter 16. That is, since the phase is changed from +90° to −90° from the lowest resonant frequency of speaker 13 to the cut-off frequency of filter 16, and the response curve is attenuated at a slow rate but is attenuated at a higher rate in the higher frequency region, a more stable feedback can be applied over a wider frequency range. FIG. 15 shows a comparison of the frequency response curves of the acoustic output signals of speaker obtained when the frequency characteristics of speaker is compensated and uncompensated.

Figure 16:
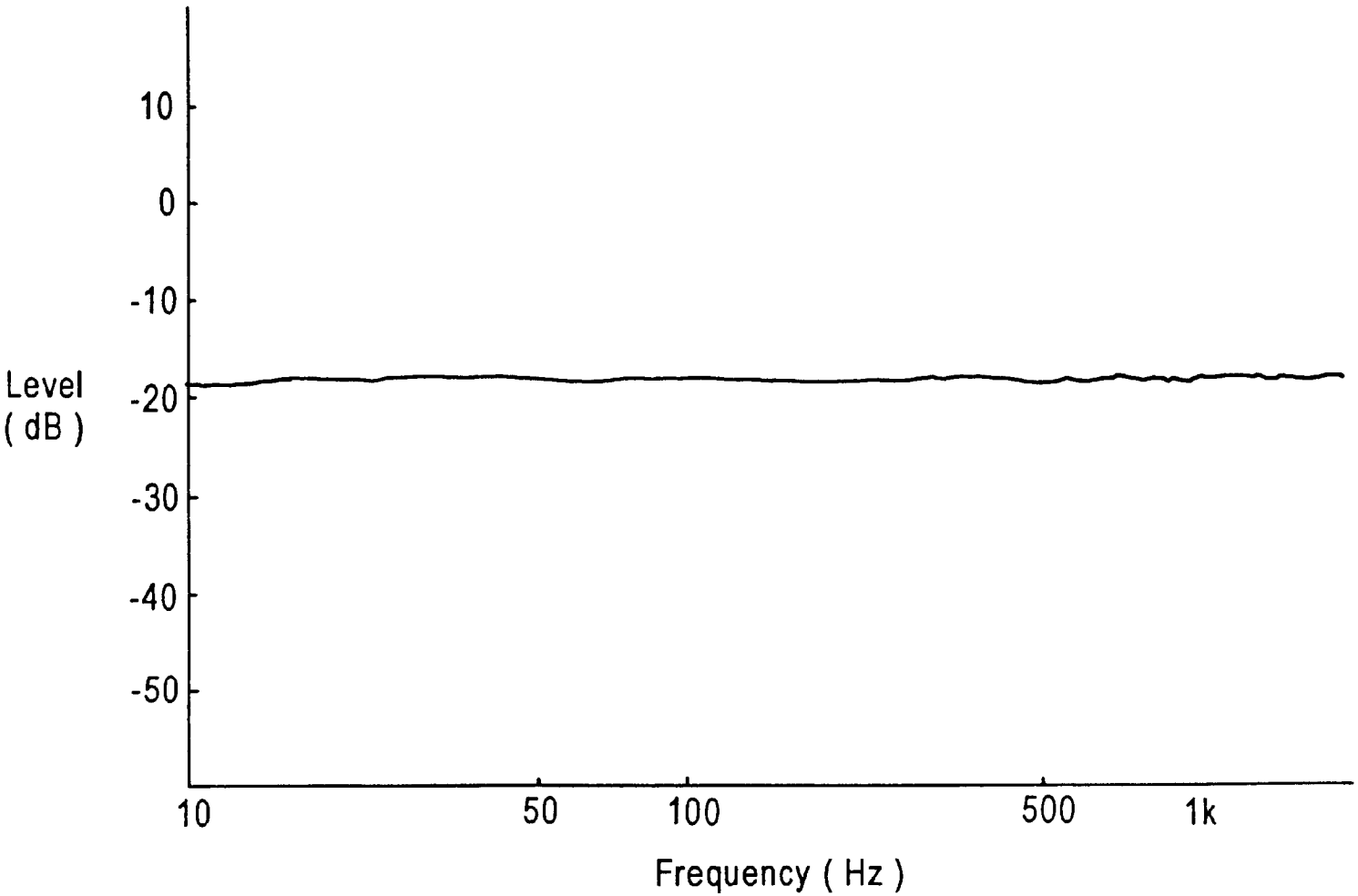
FIG. 16 shows a characteristic curve showing frequency characteristics of the microphone used in an embodiment of the invented sound reproduction apparatus.

Moreover, a sound reproduction apparatus in Form-5 is now explained as an embodiment of the invention. Since microphone 14 used in this invention is an electret type capacitor microphone having a flat frequency characteristics as shown in FIG. 16, it can be used as a compact microphone having excellent characteristics for the detection of acoustic output signals.

Figure 17:
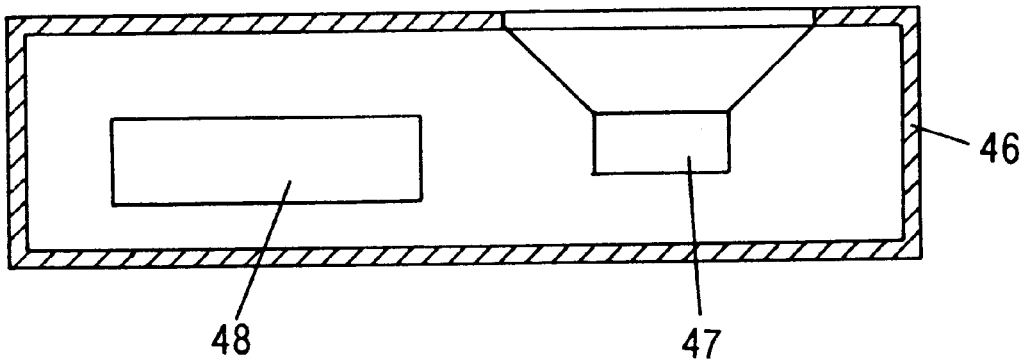
FIG. 17 shows a cross-section of the speaker cabinet in Form-6 which is an embodiment of the invented sound reproduction apparatus.
Figure 18:
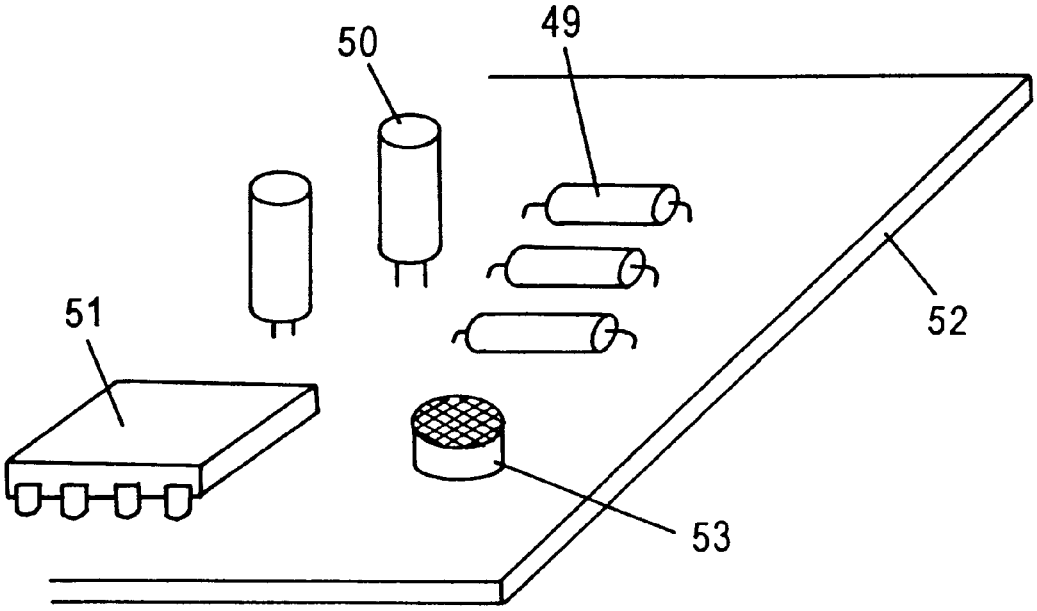
FIG. 18 shows a mounted state of the microphone in an embodiment of the invented sound reproduction apparatus.

Then, a sound reproduction apparatus in Form-6 as an embodiment of the invention is now explained in next. When this invented sound reproduction apparatus is employed, circuit section 48 (the circuit section shown in FIG. 1) and speaker 47 are combined together as an unit housed in closed cabinet 46 as shown in FIG. 17.

In order to obtain this system construction, resistor 49, capacitor 50, and semiconductor 51 are mounted on printed circuit board 52 on which circuit section 48 is mounted together with microphone 53 for the detection of acoustic signals. By this, microphone 53 and the microphone amplifier can be combined at a shortest distance without a special wiring between these, and a system having excellent characteristics can be realized at a low cost.

As shown by the above embodiment of the invention, by employing this invented circuit construction, a negative feedback circuit around the lowest resonant frequency can be obtained by applying an operational detection and a processing to the signal detected by a microphone in order to secure S/N ratio enough.

Moreover, by adding the phase difference between the signal inputted in the speaker and the acoustic signal radiated out of the speaker, and by feeding back only the in-phase signal components, the oscillation due to positive feedback can be effectively suppressed so that the negative feedback becomes applicable in a wide frequency range.

Although these embodiments of the invention have been explained by taking an example for an active filter consisted of analog circuits, it is needless to say that the same function and performance can be obtained by using a means of digital filter.

Although the cutoff frequency of filter shown in Form-2 of the embodiment is set at a frequency of 400 Hz which belongs to a middle frequency, the invention is not limited within this frequency range. Though the cutoff-frequency of this filter shown in Form-4 of the embodiment is set at a neighborhood of 1 kHz, this means that the setting is made at a frequency region higher than that of Form-2. However, this does not means that this is limited within these numerical values of the frequency.

This invention is not only limited within said embodiments of the invention, but is applicable to the many other modifications of this invention including the entire variations within the spirit and the scope of the invention.

What is claimed is:

1. A sound reproduction apparatus comprising:

an input terminal for receiving input signals;

a subtracting means having a positive input terminal coupled to said input terminal and a negative input terminal for receiving another signal;

a power amplifying means for amplifying an input signal supplied from said subtracting means;

a speaker for reproducing a sound signal from an output signal of said power amplifying means;

a closed box for enclosing said speaker;

a microphone for detecting the sound signal radiated from said speaker;

a microphone amplifying means for amplifying the sound signal detected by said microphone;

a filtering means for processing an output signal of said microphone amplifying means; and a summing means for adding an output signal of said filtering means to the input signal of said power amplifying means;

wherein an output signal of said summing means is supplied to said negative input terminal as said other signal in order to form a negative feedback loop; and wherein a second order high-pass filter having a cut-off frequency same as the lowest resonant frequency of said speaker is used as said filtering means.

2. A sound reproduction apparatus comprising:

an input terminal for receiving input signals;

a subtracting means having a positive input terminal coupled to said input terminal and a negative input terminal for receiving another signal;

a power amplifying means for amplifying an input signal supplied from said subtracting means;

a speaker for reproducing a sound signal from an output signal of said power amplifying means;

a closed box for enclosing said speaker;

a microphone for detecting the sound signal radiated from said speaker;

a microphone amplifying means for amplifying the sound signal detected by said microphone;

a filtering means for processing an output signal of said microphone amplifying means; and a summing means for adding an output signal of said filtering means to the input signal of said power amplifying means;

wherein an output signal of said summing means is supplied to said negative input terminal as said other signal in order to form a negative feedback loop; and wherein a second order high-pass filter having a cut-off frequency higher than the lowest resonant frequency of said speaker is used as said filtering means.

3. The filter according to claim 2, wherein the cut-off frequency of said filter is set at about 400 Hz.

4. A sound reproduction apparatus comprising:

an input terminal for receiving input signals;

a subtracting means having a positive input terminal coupled to said input terminal and a negative input terminal for receiving another signal;

a power amplifying means for amplifying an input signal supplied from said subtracting means;

a speaker for reproducing a sound signal from an output signal of said power amplifying means;

a closed box for enclosing said speaker;

a microphone for detecting the sound signal radiated from said speaker;

a microphone amplifying means for amplifying the sound signal detected by said microphone;

a filtering means for processing an output signal of said microphone amplifying means; and a summing means for adding an output signal of said filtering means to the input signal of said power amplifying means;

wherein an output signal of said summing means is supplied to said negative input terminal as said other signal in order to form a negative feedback loop; and wherein a first order high-pass filter having a cut-off frequency same as the lowest resonant frequency of said speaker is used as said filtering means.

5. A sound reproduction apparatus comprising:

an input terminal for receiving input signals;

a subtracting means having a positive input terminal coupled to said input terminal and a negative input terminal for receiving another signal;

a power amplifying means for amplifying an input signal supplied from said subtracting means;

a speaker for reproducing a sound signal from an output signal of said power amplifying means;

a closed box for enclosing said speaker;

a microphone for detecting the sound signal radiated from said speaker;

a microphone amplifying means for amplifying the sound signal detected by said microphone;

a filtering means for processing an output signal of said microphone amplifying means; and a summing means for adding an output signal of said filtering means to the input signal of said power amplifying means;

wherein an output signal of said summing means is supplied to said negative input terminal as said other signal in order to form a negative feedback loop; and wherein a first order high-pass filter having a cut-off frequency higher than the lowest resonant frequency of said speaker is used as said filtering means.

6. The filter according to claim 5, wherein the cut-off frequency of said filter is set at about 1 kHz.

7. A sound reproduction apparatus comprising:

an input terminal for receiving input signals;

a subtracting means having a positive input terminal coupled to said input terminal and a negative input terminal for receiving another signal;

a power amplifying means for amplifying an input signal supplied from said subtracting means;

a speaker for reproducing a sound signal from an output signal of said power amplifying means;

a microphone for detecting the sound signal radiated from said speaker;

a filtering means for processing an output signal of said microphone; and a summing means for adding an output signal of said filtering means to the input signal of said power amplifying means;

wherein an output signal of said summing means is supplied to said negative input terminal as said other signal in order to form a negative feedback loop.

8. The sound reproduction apparatus according to claim 7, wherein an electret capacitor microphone is used as said microphone and is located near a microphone amplifying means.

9. The sound reproduction apparatus according to claim 8, wherein said microphone is mounted on a printed circuit board together with said subtracting means, said power amplifying means, said microphone amplifying means, said filtering means and said summing means, and wherein said microphone and said microphone amplifying means are separated by a short distance from each other.

10. The sound reproduction apparatus according to claim 7, wherein said microphone is mounted on a printed circuit board together with said subtracting means, said power amplifying means, a microphone amplifying means, said filtering means and said summing means, and wherein said microphone and said microphone amplifying means are separated by a short distance from each other.

11. The sound reproduction apparatus according to claim 7, wherein said microphone is located within a closed box together with said speaker.

12. A sound reproduction apparatus comprising:

an input terminal for receiving input signals;

a subtracting means having a positive input terminal coupled to said input terminal and a negative input terminal for receiving another signal;

a power amplifying means for amplifying an input signal supplied from said subtracting means;

a speaker for reproducing a sound signal from an output signal of said power amplifying means;

a closed box for enclosing said speaker;

a microphone for detecting the sound signal radiated from said speaker;

a microphone amplifying means for amplifying the sound signal detected by said microphone;

a high-pass filter for compensating the phase of an output signal of said microphone amplifying means;

wherein the phase-shift of the output signal of said microphone amplifying means is kept from +90° to −90°; and a summing means for adding an output signal of said filter to the input signal of said power amplifying means;

wherein an output signal of said summing means is supplied to said negative input terminal as said other signal in order to form a negative feedback loop.

13. A sound reproduction apparatus comprising:

an input terminal for receiving input signals;

a subtracting means having a positive input terminal coupled to said input terminal and a negative input terminal for receiving another signal;

a power amplifying means for amplifying an input signal supplied from said subtracting means;

a speaker for reproducing a sound signal from an output signal of said power amplifying means;

a closed box for enclosing said speaker;

a microphone for detecting the sound signal radiated from said speaker;

a microphone amplifying means for amplifying the sound signal detected by said microphone;

a filtering means for processing an output signal of said microphone amplifying means; and a summing means for adding an output signal of said filtering means to the input signal of said power amplifying means;

wherein the output signal of said summing means is supplied to said negative input terminal as said other signal in order to form a negative feedback loop; and wherein an electret capacitor microphone is used as said microphone and is located in said closed box near said microphone amplifying means.

14. A sound reproduction apparatus comprising:

an input terminal for receiving input signals;

a subtracting means having a positive input terminal coupled to said input terminal and a negative input terminal for receiving another signal;

a power amplifying means for amplifying an input signal supplied from said subtracting means;

a speaker for reproducing a sound signal from an output signal of said power amplifying means;

a closed box for enclosing said speaker;

a microphone for detecting the sound signal radiated from said speaker;

a microphone amplifying means for amplifying the sound signal detected by said microphone;

a filtering means for processing an output signal of said microphone amplifying means; and a summing means for adding an output signal of said filtering means to the input signal of said power amplifying means;

wherein the output signal of said summing means is supplied to said negative input terminal as said other signal in order to form a negative feedback loop;

wherein said microphone is mounted in said closed box on a printed circuit board together with said subtracting means, said power amplifying means, said microphone amplifying means, said filtering means and said summing means; and wherein said microphone and said microphone amplifying means are separated by a short distance from each other.

15. A sound reproduction apparatus comprising:

an input terminal for receiving input signals;

a subtracting means having a positive input terminal coupled to said input terminal and a negative input terminal for receiving another signal;

a power amplifying means for amplifying an input signal supplied from said subtracting means;

a speaker for reproducing a sound signal from an output signal of said power amplifying means;

a closed box for enclosing said speaker;

a microphone for detecting the sound signal radiated from said speaker;

a microphone amplifying means for amplifying the sound signal detected by said microphone;

a filtering means for processing an output signal of said microphone amplifying means; and a summing means for adding an output signal of said filtering means to the input signal of said power amplifying means;

wherein an output signal of said summing means is supplied to said negative input terminal as said other signal in order to form a negative feedback loop; and wherein said microphone is located within said closed box together with said speaker.

* * * * *